US007798621B2

(12) United States Patent
Nottelman et al.

(10) Patent No.: US 7,798,621 B2
(45) Date of Patent: Sep. 21, 2010

(54) INKJET PRINTER WITH CARTRIDGE FOR INK PELLETS

(75) Inventors: Frank J. H. Nottelman, Belfeld (NL); Sandor H. G. Joppen, Grubbenvorst (NL)

(73) Assignee: Océ-Technologies B.V., Venlo (NL)

( * ) Notice: Subject to any disclaimer, the term of this patent is extended or adjusted under 35 U.S.C. 154(b) by 878 days.

(21) Appl. No.: 11/653,905

(22) Filed: Jan. 17, 2007

(65) Prior Publication Data

US 2007/0165083 A1 Jul. 19, 2007

(30) Foreign Application Priority Data

Jan. 18, 2006 (EP) ..... 06100540

(51) Int. Cl.
*B41J 2/175* (2006.01)

(52) U.S. Cl. ..... 347/86

(58) Field of Classification Search ..... 347/84–86, 347/88

See application file for complete search history.

(56) References Cited

U.S. PATENT DOCUMENTS 4,636,803 A 1/1987 Mikalsen
5,341,164 A * 8/1994 Miyazawa et al. ..... 347/88
6,422,694 B1 * 7/2002 Hollands ..... 347/88

FOREIGN PATENT DOCUMENTS

EP 0178882 A1 4/1985
EP 0338590 A2 10/1989
EP 1101617 B1 5/2001

* cited by examiner

*Primary Examiner*—An H Do
(74) *Attorney, Agent, or Firm*—Birch, Stewart, Kolasch & Birch, LLP

(57) ABSTRACT

An inkjet printer including a cartridge for holding ink pellets and means for separating and releasing a single ink pellet and feeding it to the ink-supply unit of a printing head, the cartridge having at least one exit for releasing an ink pellet, wherein the separating and releasing means includes a rotatable shaft extending in a first transport direction provided with a spiralling member at the circumference of said shaft and a tangential movement confining member extending in a parallel direction with respect to said rotatable shaft, positioned at a distance from said spiralling member for confining the tangential movement of an ink pellet, engaging with said spiralling member to form a stable position for transporting said ink pellet in said first transport direction.

27 Claims, 5 Drawing Sheets

INKJET PRINTER WITH CARTRIDGE FOR INK PELLETS

This application claims priority to European Patent Application No. 06100540.1 filed on Jan. 18, 2006 in Europe, the entire contents of which is hereby incorporated by reference in its entirety.

BACKGROUND OF THE INVENTION

The present invention relates to an inkjet printer comprising a cartridge for holding ink pellets and means for separating and releasing a single ink pellet and feeding it to the ink-supply unit of a printing head, the cartridge having at least one exit for releasing an ink pellet. The present invention also relates to a cartridge for holding ink pellets with means for separating and releasing individual ink pellets.

A printer of the above type is known from EP 1 101 617. The dispensing device in this printer comprises a holder extending vertically to hold spherically shaped ink pellets. The base of this holder extends to a separating unit for separating the ink pellets, one by one. This separating unit separates an ink pellet from the supply of ink pellets by making a single separating action. The specific construction of the separating unit prevents two or more ink pellets from being dispensed simultaneously. However, it is a disadvantage of this known inkjet printer that the separation of the ink pellets is relatively unreliable. Typically, no ink pellet is dispensed in one of the thousand separating actions of the separating unit. Particularly in applications where a high ink demand is required, for example in the printing of full-color posters, this can lead to a situation in which printing must be temporarily interrupted or else print artefacts form. Another disadvantage of the known dispensing device is that a separating action is accompanied by relatively considerable noise, which is a nuisance to a user.

SUMMARY OF THE INVENTION

The object of the present invention is to provide a dispensing device by means of which ink pellets can be separated with a very high degree of reliability. To this end, an inkjet printer is provided wherein the separating and releasing means comprise a rotatable shaft extending in a first transport direction and comprising a spiralling member at the circumference of said shaft and further comprises a tangential movement confining member extending in a parallel direction with respect to said rotatable shaft, positioned at a distance from said spiralling member, for confining the tangential movement of an ink pellet, and engaging with said spiralling member to form a stable position for transporting said ink pellet in said first transport direction.

In a first aspect of the inkjet printer according to the present invention individual ink pellets, stored in a cartridge, are separated and transported to an exit by means of a rotatable shaft comprising a spiralling member at its circumference while the tangential movement of the pellets during their transport to the exit is confined by a tangential movement confining member. When the printer's control means indicate the need for a pellet, the rotatable shaft can be driven to rotate one revolution. This will transport one single pellet to the exit of the cartridge, which pellet can be dispensed to the print head to fulfil the need for ink. This separation and release of exactly one single pellet per rotation is highly reliable, both in the sense of releasing just a single pellet and in the sense of not releasing a pellet at all.

In one embodiment, the cartridge incorporating the means for separating and releasing an ink pellet is suitable for manual installment on the inkjet printer. This is useful as operators can easily change an empty cartridge with a full cartridge. Features can be added to simplify the identification cartridges with pellets of different colors, such as a color coding or a keying grip at the connection surface between the printer and the cartridge, prohibiting a connection of a cartridge of a wrong color to prevent mixture of different colored pellets in the print head.

In another embodiment the rotatable shaft is in an operating position, positioned at an angle with respect to the direction of the gravitation force, such that on each winding two areas can be distinguished; a first, stable area in which an ink pellet tends to roll towards the tangential movement confining member; and a second, unstable area in which an ink pellet tends to roll away from the tangential movement confining member and off the spiralling member. This is useful as the pellets that are located on the unstable second area will roll off the spiralling member, while the pellets on the first, stable area will roll towards the tangential movement confining member. Stable transport locations arise between the rotatable shaft, the spiralling member and the tangential movement confining member.

In a further embodiment the tangential movement confining member is positioned with respect to the spiralling member, such that only one single position for the transportation of an ink pellet is formed in said first stable area on each winding of the spiralling member. This results in a separating mechanism in which one single pellet will take place on each winding and will, when driven, be transported from the bulk storage via the spiralling member and the exit to the dispensing device, which will dispense the pellet into the printhead. This way of separating is very efficient and very reliable.

In a further embodiment the angle of the rotatable shaft with respect to the direction of the gravitation force in the operatively connected state, is larger than or equal to the pitch angle of the spiralling member with respect to the plane extending perpendicular to the direction of the rotatable shaft. This arrangement results in a reliable and highly efficient separating mechanism for ink pellets in bulk storage, such as the present cartridge as positioned on the printer.

In another embodiment the means for separating a single ink pellet is an integrated part of the inkjet printer. By incorporating the rotatable shaft and/or the tangential movement confining member on the printer, the technical complexity of the cartridge lowers significantly.

In one embodiment the cartridge is releasably connectable to the inkjet printer. This contributes to the easy handling of the cartridge and easy installment onto the printer. Thus an empty or defect cartridge can conveniently be renewed.

In another embodiment the means for separating and releasing a single ink pellet is an integrated part of the cartridge. By making these means an integrated part of the cartridge, the tuning of the position and angles can be relatively accurate, while the cartridge remains a relative closed system. This has a positive influence on the sensibility to dust and other polluting matter.

In a further embodiment the rotatable shaft is an integrated part of the cartridge and the cartridge is operatively connected to the inkjet printer, and comprises means for positioning the cartridge on the inkjet printer such that the angle of the rotatable shaft with respect to the direction of the gravitation force in operatively connected state, is larger than or equal to the pitch angle of the spiralling member with respect to the plane extending perpendicular to the direction of the rotatable shaft. These means for positioning the cartridge on the printer in a certain position and orientation contribute to the efficient and reliable separation and transportation inside the cartridge while the installation of new cartridges remains easy.

In another embodiment the inkjet printer comprises driving means and the rotatable shaft comprises receiving means which are operatively engageable to said driving means. By operatively engaging the rotatable shaft and the drive means the rotatable shaft can be driven inside the cartridge, while the system remains safely closed to prevent the intrusion of polluting matter inside the cartridge.

In one embodiment the tangential movement confining member is a rotatable roll. By rotating the roll which roll functions as a tangential movement confining member a pellet is less likely to be clamped into the wedge-formed space between the spiralling member and the tangential movement confining member. The rotation of the roll in the same angular direction as the rotation of the shaft will make the pellet rotate out of the wedge, thereby positioning the pellet in the free and controllable area of the cartridge, not jamming the shaft while in function. Rotating the roll at a angular velocity which is larger or equal to the angular velocity of the shaft will even enlarge the anti-jamming effect of the roll.

In another aspect, the present invention relates to a cartridge for holding ink pellets with means for separating and releasing individual ink pellets, which cartridge is suitable for manual installment on an inkjet printer, comprising a housing having at least one exit for releasing an ink pellet and a rotatable shaft extending in a first transport direction comprising a spiralling member at the circumference of said shaft and a tangential movement confining member extending in a parallel direction with respect to said rotatable shaft, positioned at a distance from said spiralling member for confining the tangential movement of an ink pellet, and engaging with said spiralling member to form a stable position for transporting said ink pellet in said first transport direction.

In one embodiment the tangential movement confining member comprises a curved wall facing at least a part of the curved wall towards the rotatable shaft. This wall is smooth enough to guide the pellet towards the exit of the cartridge.

In another embodiment the tangential movement confining member comprises a rotatable roll. This roll will guide the pellet towards the exit, while forming a stable position in engagement with the spiralling member. The rotatability of the roll enables the pellet to be rolled out of the wedge-formed space between the spiralling member and the tangential movement confining member for preventing a jamming clamp of the pellet in this wedge-formed space. This anti-jamming effect is even larger when the roll is rotatable in the same direction as the shaft.

In another embodiment, the pitch of the spiralling member is larger than the height of an ink pellet and smaller than two times the height of an ink pellet. In this arrangement there is only space for one pellet in the vertical direction. This has a positive effect on the separation efficiency of the cartridge.

In another embodiment, the cartridge further comprises means for detecting the release of an ink pellet at the at least one exit. In this embodiment the means for detecting the release of an ink pellet comprises a moveable detection member positioned near the at least one exit, which moveable detection member, in operation, is moveable from a first to a second position under the influence of a passing ink pellet. These means for detecting the release of an ink pellet contribute to the ability of administrating the actual content of the cartridge and enable the detection of successful release for control reasons.

In another embodiment the cartridge further comprises static guiding means for guiding a single ink pellet to a stable position formed by said tangential movement confining member and said spiralling member. In one embodiment these guiding means comprise a funnel, which comprises a first wide end and a second smaller end, which is positioned and formed such that a single ink pellet is guided from the wide end through the smaller end into said stable position, while obviating bridging between ink pellets. This ensures a free entrance of pellets from the bulk storage to the spiralling member.

In another embodiment said rotatable shaft comprises receiving means which are operatively engageable to external driving means. This enables the rotatable means to be driven by driving means on the printer while installed and functioning.

BRIEF DESCRIPTION OF THE DRAWINGS

The present invention will now be explained with reference to the following drawings, wherein.

DETAILED DESCRIPTION OF THE INVENTION

Figure 1:
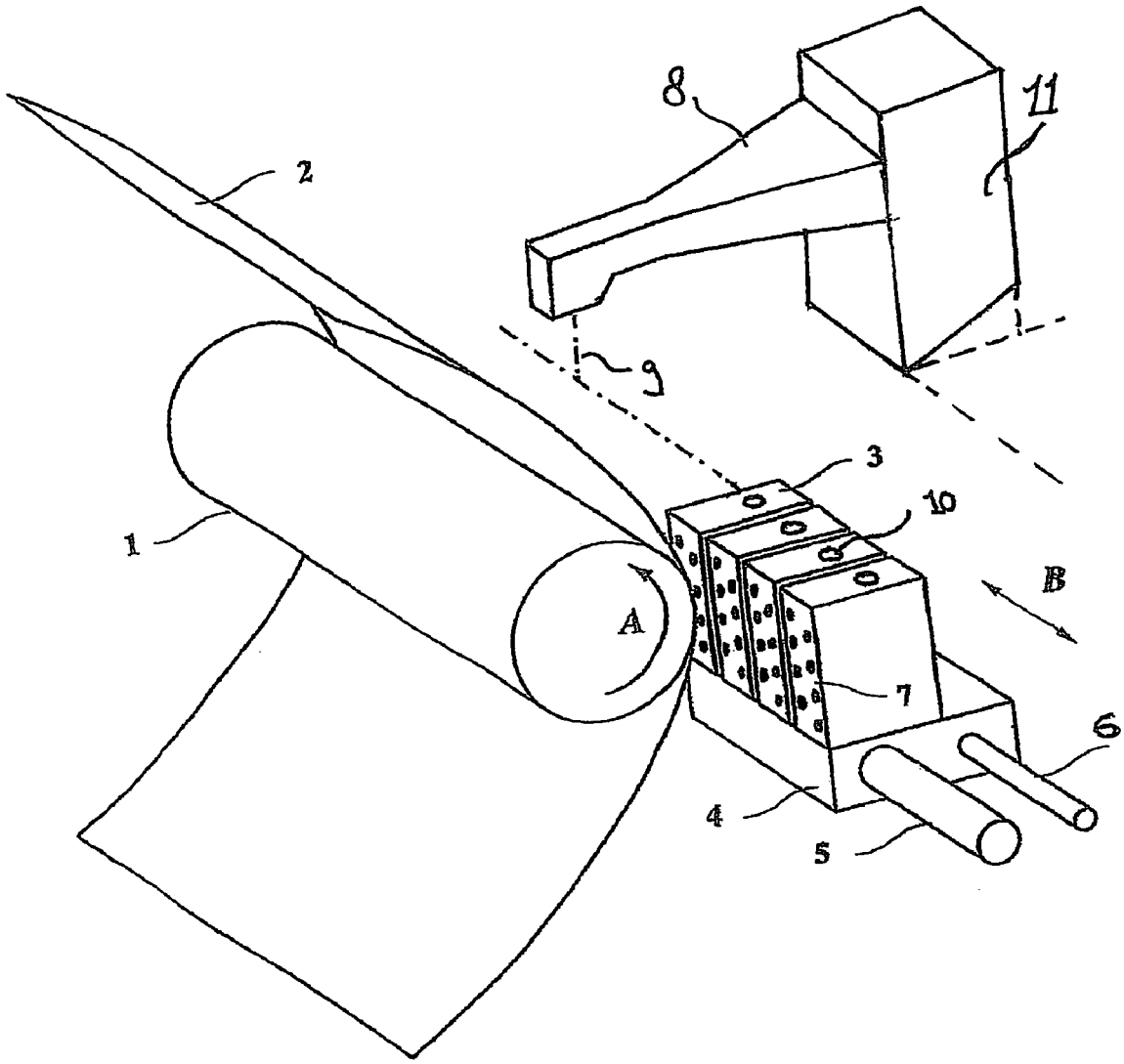
FIG. 1 is a diagram showing an inkjet printer and a dispensing device according to the present invention.

FIG. 1 shows a printer provided with ink ducts. In this embodiment the printer comprises a roller 1 to support a substrate 2 and move it along the four printheads 3. The roller 1 is rotatable about its axis as indicated by arrow A. A carriage 4 carries printheads 3 and can be moved in reciprocation in the direction indicated by the double arrow B, parallel to roller 1. In this way printheads 3 can scan the receiving substrate 2, for example a sheet of paper. The carriage 4 is guided over rods 5 and 6 and is driven by means suitable for the purpose (not shown).

In the embodiment as illustrated in the drawing, each printhead contains eight ink ducts, each with its own nozzle 7, which form two rows of four nozzles each perpendicular to the axis of the roller 1. In a practical embodiment of a printer, the number of ink ducts per printhead will be many times greater. Each ink duct is provided with means for energizing the ink duct (not shown) and an associated electric actuation circuit (not shown). In this way, the ink duct, the said means for energizing the ink duct, and the actuation circuit form a unit which can serve to eject ink drops in the direction of roller 1. If the ink ducts are energized image-wise, an image forms which is build up from ink drops on the substrate 2.

When a substrate is printed with a printer of this kind in which ink drops are ejected from ink ducts, the substrate, or part thereof, is (imaginarily) divided into fixed locations which form a regular field of pixel rows and pixel columns. In one embodiment, the pixel rows are perpendicular to the pixel columns. The resulting separate locations can each be provided with one or more ink drops. The number of locations per unit of length in the directions parallel to the pixel rows and pixel columns is termed the resolution of the printed image, and is indicated, for example, as 400×600 d.p.i. ("dots per inch"). By the image-wise energization of a row of nozzles of the printhead of the printer when it moves over a strip of the substrate in a direction substantially parallel to the pixel rows, the row of nozzles being substantially parallel to the pixel columns, as shown in FIG. 1, an image built up from ink drops is formed on the substrate.

In this embodiment, the printer is provided with a number of dispensing devices 8, one for each color, only one being shown in FIG. 1 for simplification. With a dispensing device of this kind it is possible to dispense ink pellets at each of the printheads. The ink used is a hot melt ink. An ink of this kind is solid at room temperature and liquid at elevated temperatures. This ink is dispensed in solid form in each of the printheads whereafter the ink in the printhead is melted and brought to operating temperature, typically 130° C. As soon as there is a likelihood of a shortage of liquid ink in one of the printheads, the carriage 4 will be so moved that the relevant printhead is disposed beneath the corresponding dispensing device level of the dispensing line 9. One or more ink pellets will then be dispensed to the printhead, said pellets entering the printhead via opening 10. These pellets are then melted and brought to operating temperature. In this way each printhead can be provided with sufficient ink at all times.

The dispensing device is fed with ink pellets by a cartridge 11 containing the ink pellets. Single ink pellets are released to the dispensing device 8 by means of a release means in the cartridge 11. It will be clear for the person skilled in the art that the dispensing device 8 can be an integrated part of the carriage or an integrated part of the printer.

Figure 2:
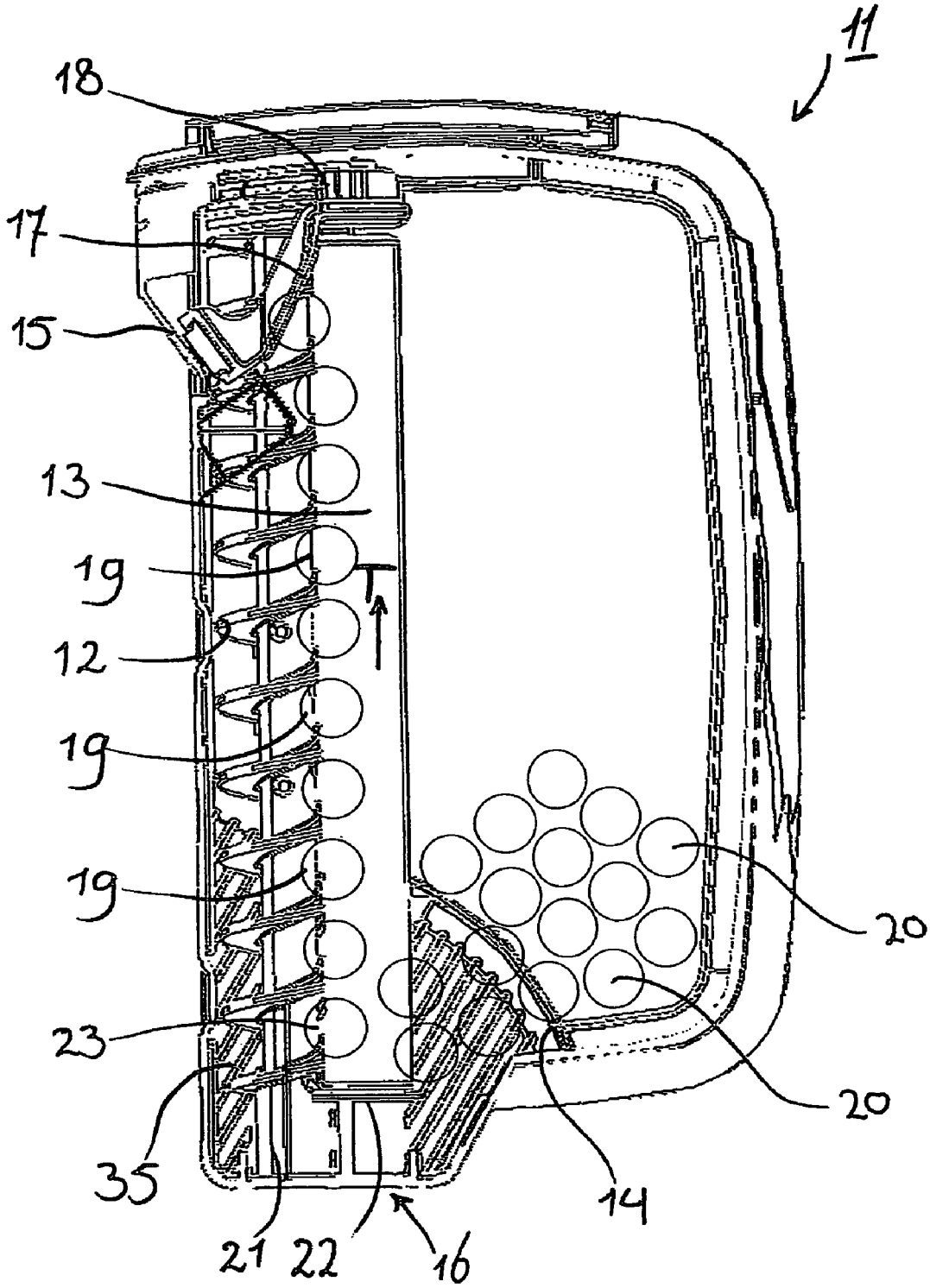
FIG. 2 is a diagrammatic view of a cross-section of a cartridge according to the invention.

FIG. 2 shows a cartridge according to the present invention. In this embodiment the cartridge 11 holds a plurality of ink pellets 20. These ink pellets are stored in an unorganised fashion. The cartridge 11 is suitable for manual installment on an inkjet printer. Therefore an operator can install the cartridge 11 on the printer by placing the contact surface 16 onto the destined surface of the printer. The printer and the cartridge comprise means for releasably connecting the cartridge 11 to the printer (not shown).

The cartridge 11 comprises a rotatable shaft comprising a spiralling member, in this embodiment implemented as a cylindrical worm 12. When driven, the rotatable worm 12 transports pellets 20 in a transport direction (here from the bottom to the top of the cartridge) indicated by arrow T. The cartridge has an exit 15 where individual ink pellets are released to the dispensing device 8. The worm 12 engages with a tangential movement confining member 13 to form a single transport location 19 on each winding of the worm 12. In this embodiment the movement confining member 13 is implemented as a rotatable cylinder. In another embodiment (not shown) the movement confining member is implemented as a curved wall, of which the outside wall, at least partly faces the worm, confining the tangential movement of the pellets, which tend to roll towards the movement confining member. In another embodiment (not shown) the movement confining member is implemented as a comb shaped member, of which the protrusive parts engage with the worm 12, confine the tangential movement of the pellets 20, and form transport locations 19 on each winding of the worm 12.

After each rotation of the worm 12, a single ink pellet 20 is released via the exit 15 to the dispensing device 8 resulting in a vacant transport location 23, which originates at the bottom of the worm 12. To overcome the problem of bridge forming pellets, which can obstruct the free entrance to the vacant transport location 23, a guide means 14 is positioned at the bottom of the cartridge 11. This guide means 14 prevents, e.g., three pellets forming a bridge, resulting in an obstruction of the entrance to the vacant transportation location 23. This guide means 14 can, e.g., be an integral part of the wall or walls, or can be a separate part positioned near bottom of the worm 12.

To be able to register the exit of a single ink pellet 20 at the exit 15, the cartridge 11 comprises a moveable detection member 17 positioned near the exit 15 of the cartridge 11. The moveable detection member 17 moves from its rest position to an elevated position under the influence of a passing ink pellet. This movement is detected by a magnetic sensor 18, which detects the change of a magnetic field under the influence of the moving detection member 17. The sensor 18 releases a signal on detection. This signal can be led, e.g., to processing or storing means on the printer or to processing or storing means inside the cartridge itself. This signal can be used, e.g., for the registration of a successful exit of an ink pellet 20, for the administration of the total number of ink pellets, to predict the up-to-date ink volume inside the printhead or the like.

In the embodiment as shown in FIG. 2 the rotatable worm 12 and the rotatable tangential movement confining member 13 are operatively connectable to driving means (not shown) on the printer. The rotatable worm 12 and the tangential movement confining member 13 comprise receiving means 21, 22 which are engageable to the external driving means. The rotatable means 12, 13 in the cartridge 11 are directly driven by the driving means. In another embodiment the cartridge comprises only one receiving means to receive the driving means, and a gear drives both rotatable means 12, 13.

In another embodiment (not shown) the rotatable worm 12 and/or the tangential movement confining member 13 and an integral part of the inkjet printer and the cartridge 11 comprise receiving means for receiving the rotatable worm 12 and/or the tangential movement confining member 13.

Figure 3:
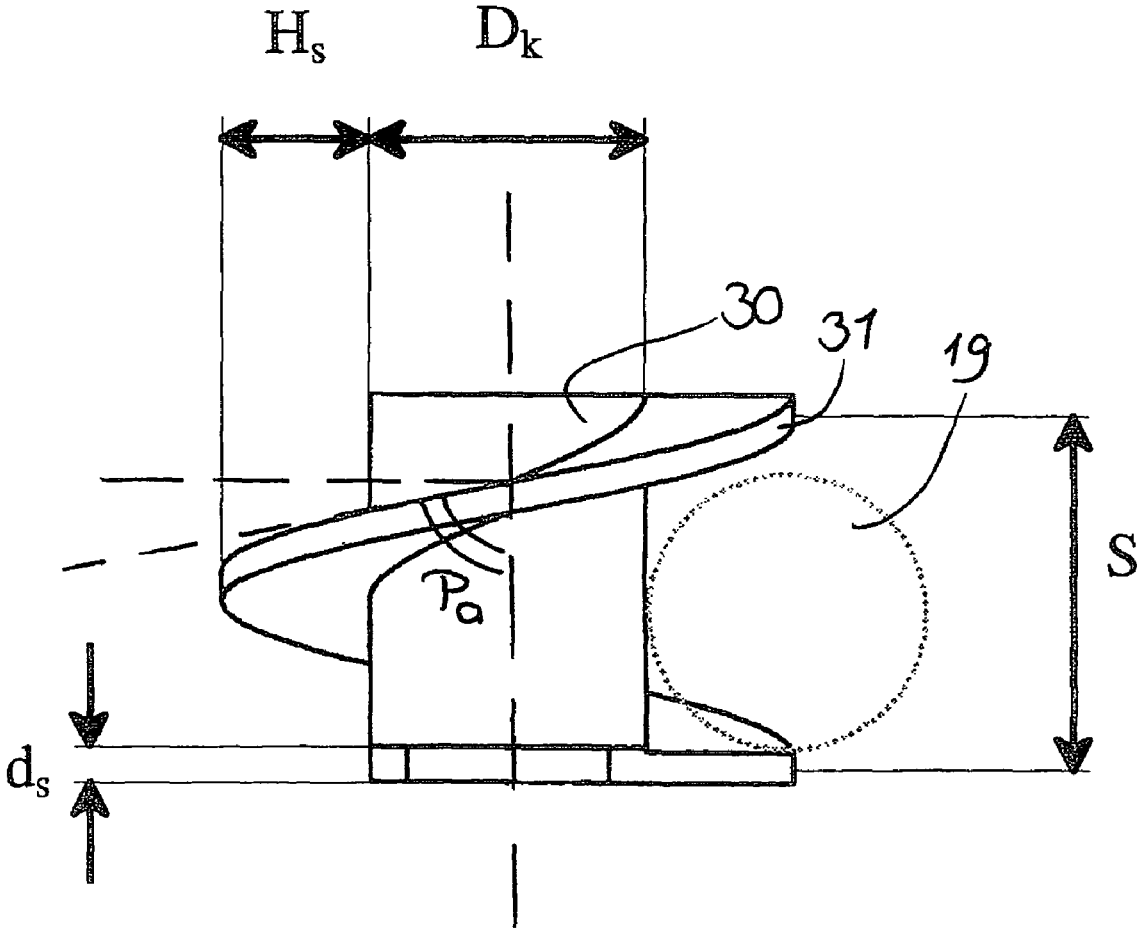
FIG. 3 is a diagrammatic section of the separation and transportation means.

In FIG. 3 a diagrammatic section of the separation and transportation means is shown in front view. One winding of the worm 12 is shown. The worm comprises a core cylinder 30 with core diameter Dk and a spiralling member 31 at its circumference. The spiralling member 31 has a member height Hs and a thickness ds. The distance between the centerlines of two consecutive windings is denoted as the pitch S of the worm. In another embodiment (not shown) these properties vary over the length of the worm 12.

The worm 12 is dimensioned such that one pellet fits in between two consecutive windings. Depending on the pellet properties, changing the dimensions of the worm 12 will influence the efficiency and stability of the separation and transportation means. The core diameter must satisfy the demands for sufficient stiffness of the shaft, but enlarging also influences the stability of the pellet on the spiralling member in a negative way. A smaller core diameter enlarges the stability of a pellet 19 on the spiralling member 31 but enlarges the sensibility of surface irregularities of the pellet, such that, in case a pellet does not roll sufficiently, the core cylinder can wear into the pellet during transportation.

The member height Hs is limited by its radial space and by the gravitational stability of a pellet as the center of gravity of the pellet must fall within the projection of the spiralling member on the plane that extends in a direction perpendicular to the direction of gravity when in operation, otherwise a pellet would fall off the spiralling member.

The core diameter Dk, member height Hs and the necessary pitch S determine the pitch angle Pa of the spiralling member 31. A smaller the pitch angle Pa results in a higher clamping force between the worm 12 and the tangential movement confining member 13.

The space between two consecutive windings must not be too large as only one pellet may be transported per winding. The pitch angle must, e.g., for the above described reason, not be too small. Therefore, enlarging the member thickness ds can limit the pellet space such that only one pellet per winding will be transported but the pitch angle remains sufficiently high to prevent too high a clamping force between the worm 12 and the tangential movement confining member 13. Good results were accomplished with core diameters between 0.5 and 2.5 times the pellet diameter and a member thickness between 0.3 and 0.7 times the pellet diameter. In this embodiment a core diameter of approximately 1.0 times the pellet diameter is chosen.

Figures 4A, 4B, 4C:
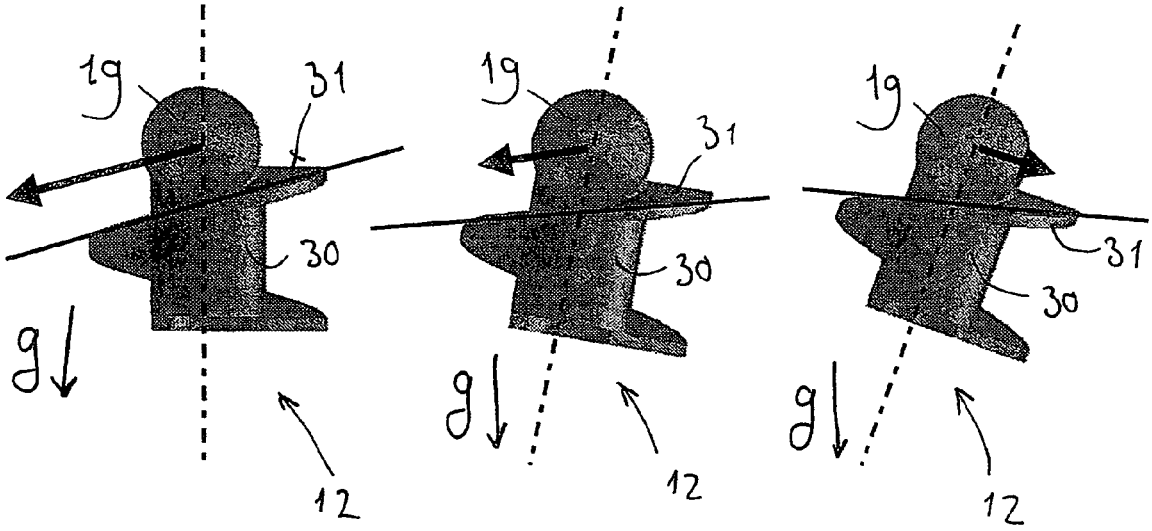
FIGS. 4*a*, 4*b* and 4*c* are diagrammatic front views of the separating means with an ink pellet.

FIGS. 4*a*, 4*b* and 4*c* show a diagrammatic front view of the separating means with an ink pellet. If the worm 12 is positioned at a straight up orientation with respect to the direction of gravity (indicated by the arrow g), as shown in FIG. 4*a*, ink pellets, which rest on the spiralling member 31 thereof, tend to roll 'down' the spiralling member 31 driven, by gravity, independent of their place on the spiralling member 31. If a tangential movement confining member (not shown) is placed next to the worm, such that the tangential movement of the pellets 19 is confined, the pellets will 'pile up', forming a row on the spiralling member, resulting in the transportation of a plurality of pellets per winding in the direction of transportation. Positioning the worm 12 at an angle with respect to the direction of gravity as shown in FIG. 4*b*, will moderate the angle with respect to gravity in some regions, resulting in a moderated drive to roll down and enlarge the angle at the other regions of the spiralling member, enlarging the tendency to roll down in those regions.

Figure 5:
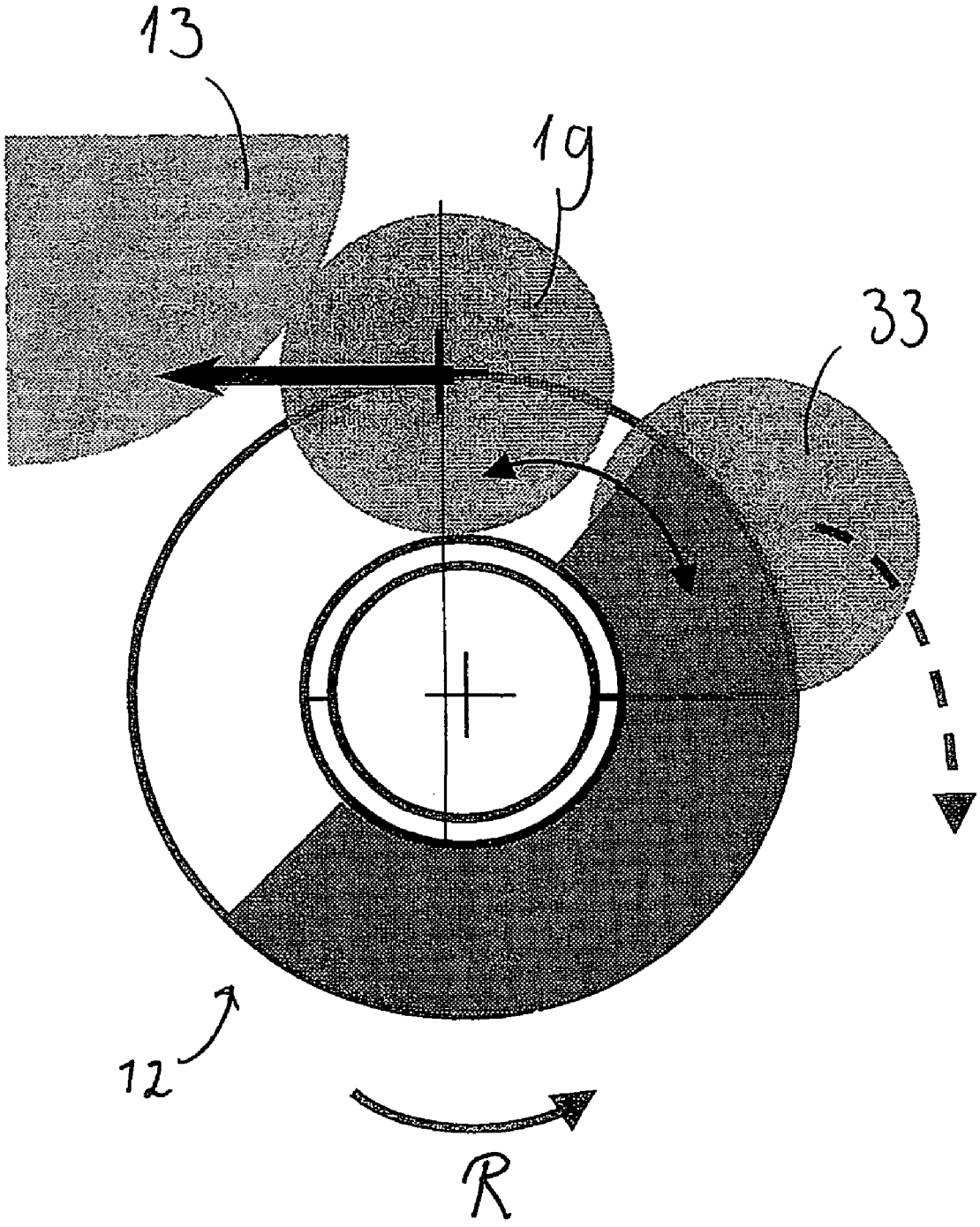
FIG. 5 is a diagrammatic top view of the separating and transporting means with ink pellets.

If, as shown in FIG. 4*c*, the worm 12 is positioned at an angle with respect to the direction of the gravitation force which is larger than or equal to the angle of the spiralling member with respect to the plane extending perpendicular to the direction of the angle of the core cylinder, two areas can be distinguished. These areas are illustrated in FIG. 5 which shows a first area of each winding in which a pellet tends to roll counter-clockwise (when seen in top view) and a second area in which a pellet tends to roll clockwise.

By placing a tangential movement confining member 13 near the worm 12 a stable pellet area arises on which pellets can be placed and transported. By placing the tangential movement confining member 13 such that only one pellet position arises in the stable first area, a separation mechanism is created wherein only one single pellet 19 can be positioned in the first stable area and all the other pellets 33 on that winding roll off the spiralling member as the other pellets 33 are positioned on the unstable second area.

In another embodiment the tangential movement confining member 13 is implemented as a rotatable cylinder, rotating in the same angular direction as the worm 12, such that pellets 19 which are transported are less likely clamped into the wedge formed space between the worm 12 and the tangential movement confining member 13. This effect is prevented even better if the rotating cylinder has a higher angular speed than the worm 12.

The space between the worm 12 and the tangential movement confining member 13 can be used to drain broken pellets. These broken pellets can disturb the ink administration and/or ink supply when supplied to the ink dispensing device 8. By the arrangement of the walls as, e.g., shown in FIG. 2 an area 35 originates, in which broken ink pellets can be stored, separated from the useable pellets. In another embodiment (not shown), this area is directly connected to a separate waste pellet exit.

It will be clear to a person skilled in the art that the rotatable shaft and/or the tangential movement confining member can be an integral part of the printer or the cartridge. If the rotatable shaft and/or the tangential movement confining member is an integral part of the printer then the cartridge is adapted to receive these parts during the installment of a cartridge. The cartridge is then adapted to receive the rotatable shaft and/or the tangential movement confining member in a well-known fashion.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. An inkjet printer comprising a cartridge for holding ink pellets and means for separating and releasing a single ink pellet at a time and feeding it to an ink-supply unit of a printing head, the cartridge having at least one exit for releasing an ink pellet, and a separating and releasing mechanism, comprising:

a rotatable shaft having a core extending in a first transport direction and containing a spiralling member provided at the circumference of said shaft for transporting the ink pellet in the first transport direction; and an ink pellet tangential movement confining member extending in a parallel direction with respect to said rotatable shaft and positioned at a distance from said spiralling member for forming with said spiralling member a stable area in which said ink pellet is transported in said first transport direction toward the at least one exit, and for confining movement of the pellet in a direction tangential to the outer circumference of the spiralling member.

2. The inkjet printer according to claim 1, wherein the cartridge is adapted for manual installment on the inkjet printer.

3. The inkjet printer according to claim 1, wherein the means for separating a single ink pellet is an integrated part of the inkjet printer.

4. The inkjet printer according to claim 3, wherein the rotatable shaft is an integrated part of the inkjet printer.

5. The inkjet printer according to claim 3, wherein the tangential movement confining member is an integrated part of the inkjet printer.

6. The inkjet printer according to claim 1, which further comprises driving means to drive the rotatable shaft.

7. The inkjet printer according to claim 1, wherein the cartridge is releasably connectable to the inkjet printer.

8. The inkjet printer according to claim 7, wherein the means for separating and releasing a single ink pellet is an integrated part of the cartridge.

9. The inkjet printer according to claim 8, wherein the rotatable shaft is an integrated part of the cartridge and the cartridge is operatively connected to the inkjet printer, and further including means for positioning the cartridge on the inkjet printer such that the angle of the rotatable shaft with respect to the direction of the gravitation force in an operatively connected state, is larger than or equal to the pitch angle of the spiralling member with respect to the plane extending perpendicular to the direction of the rotatable shaft.

10. The inkjet printer according to claim 1, wherein the inkjet printer comprises driving means and the rotatable shaft comprises receiving means which are operatively engageable to said driving means.

11. The inkjet printer according to claim 1, wherein the tangential movement confining member is a rotatable roll.

12. The inkjet printer according to claim 11, wherein the rotatable roll is adapted to be driven such that the angular velocity of the roll is larger than or equal to the angular velocity of the rotatable shaft.

13. An inkjet printer comprising a cartridge for holding ink pellets and means for separating and releasing a single ink pellet at a time and feeding it to an ink-supply unit of a printing head, the cartridge having at least one exit for releasing an ink pellet, a separating and releasing mechanism comprising:

a rotatable shaft extending in a first transport direction and containing a spiralling member provided at the circumference of said shaft; and a tangential movement confining member extending in a parallel direction with respect to said rotatable shaft and positioned at a distance from said spiralling member for confining the tangential movement of an ink pellet, engaging with said spiralling member to form a stable position for transporting said ink pellet in said first transport direction, wherein the rotatable shaft is positioned at an angle with respect to the direction of the gravitation force, such that on each winding of the spiraling member two areas can be distinguished; a first stable area on which an ink pellet tends to roll towards the tangential movement confining member; and a second unstable area on which an ink pellet tends to roll away from the tangential movement confining member and off the spiralling member.

14. The inkjet printer according to claim 13, wherein the tangential movement confining member is positioned with respect to the spiralling member, such that only one single position for the transportation of an ink pellet is formed in said first stable area on each winding of the spiralling member.

15. The inkjet printer according to claim 13, wherein the angle of the rotatable shaft with respect to the direction of the gravitation force in operatively connected state, is larger than or equal to the pitch angle of the spiralling member with respect to the plane extending perpendicular to the direction of the rotatable shaft.

16. A cartridge for holding ink pellets with means for separating and releasing individual ink pellets, which cartridge is adapted for manual installment on an inkjet printer, which comprises:

a housing having at least one exit for releasing an ink pellet;

a rotatable shaft having a core extending in a first transport direction with a spiralling member provided at the circumference of said shaft for transporting the ink pellet in the first transport direction; and an ink pellet tangential movement confining member extending in a parallel direction with respect to said rotatable shaft, and positioned at a distance from said spiralling member for forming with said spiralling member a stable area in which said ink pellet is transported in said first transport direction toward the at least one exit, and for confining movement of the pellet in a direction tangential to the outer circumference of the spiralling member.

17. The cartridge according to claim 16 wherein the tangential movement confining member comprises a curved wall facing at least a part of the curved wall towards the rotatable shaft.

18. The cartridge according to claim 16, wherein the tangential movement confining member comprises a rotatable roll.

19. The cartridge according to claim 18, wherein the rotatable roll is rotatable in the same rotational direction as the rotatable shaft.

20. The cartridge according to claim 16, wherein the pitch of a winding of the spiralling member is larger than the height of an ink pellet and smaller than two times the height of an ink pellet.

21. The cartridge according to claim 16, which further comprises means for detecting the release of an ink pellet at the at least one exit.

22. The cartridge according to claim 21, wherein the means for detecting the release of an ink pellet comprise a moveable detection member positioned near the at least one exit, which moveable detection member is adapted to move from a first to a second position under the influence of a passing ink pellet.

23. The cartridge according to claim 22, further comprising a sensor, which is adapted to detect a positional change of the moveable detection member.

24. The cartridge according to claim 23, wherein the sensor is adapted to detect a positional change of the moveable detection member by detecting a change of magnetic field.

25. The cartridge according to claim 16, further comprising static guiding means for guiding a single ink pellet to a position in the stable area formed by said tangential movement confining member and said spiralling member.

26. The cartridge according to claim 25, wherein said guiding means comprise a funnel with a first wide end and a second smaller end, which is positioned and formed such that a single ink pellet is guided from the wide end through the smaller end into said position, while tending to prevent bridging between ink pellets.

27. The cartridge according to claim 16, wherein said rotatable shaft comprises receiving means which are operatively engageable with external driving means.

* * * * *